United States Patent [19]

Berney

[11] 4,336,608

[45] Jun. 22, 1982

[54] ELECTRONIC TIMEPIECE

[75] Inventor: Jean-Claude Berney, Epalinges, Switzerland

[73] Assignee: Ebauches S.A., Neuchatel, Switzerland

[21] Appl. No.: 135,741

[22] Filed: Mar. 31, 1980

Related U.S. Application Data

[63] Continuation of Ser. No. 881,162, Feb. 24, 1978, abandoned.

[30] Foreign Application Priority Data

Feb. 28, 1977 [CH] Switzerland ..... 2460/77

[51] Int. Cl.³ ..... G04C 19/00; G04F 5/00; G04B 17/12

[52] U.S. Cl. ..... 368/82; 368/87; 368/156; 368/200

[58] Field of Search ..... 368/82, 87, 156–160, 368/185–188, 200–202, 204

[56] References Cited

U.S. PATENT DOCUMENTS

| | | | |
|---|---|---|---|
| 3,895,480 | 7/1975 | Hammer et al. | 368/201 |
| 3,945,194 | 3/1976 | Gollinger | 368/156 |
| 4,055,945 | 11/1977 | Schwarzschild et al. | 368/201 |
| 4,092,820 | 6/1978 | Kume et al. | 368/185 |
| 4,199,726 | 4/1980 | Bukosky et al. | 368/200 |
| 4,254,494 | 3/1981 | Maeda | 368/201 |

*Primary Examiner*—Vit W. Miska

*Attorney, Agent, or Firm*—Wender, Murase & White

[57] ABSTRACT

An electronic timepiece comprising means to appreciably increase the number of distinctive information which can be introduced and, if necessary memorized, for a given number of terminals intended for that purpose, information needed for the adjustment of the frequency. The integrated circuit of the timepiece is provided with a first group of m terminals and it comprises an introduction circuit having inputs reserved to introduce the desired information, these inputs being connected to a second group of n terminals of the integrated circuit. The introduction circuit has also control inputs and each of the n terminals of the second group is capable to be connected, by a connection external to the integrated circuit, with one of the m terminals of the first group. The introduction circuit is arranged in such a way as to deliver to its outputs, at least periodically, one distinctive information for each of the $m^n$ possible combinations of the mentioned connections.

4 Claims, 6 Drawing Figures

ELECTRONIC TIMEPIECE

This is a continuation of application Ser. No. 881,162, filed Feb. 24, 1978, now abandoned.

BACKGROUND OF THE INVENTION

This invention relates to an electronic timepiece comprising an electric power supply source, a piezoelectric resonator, display means for time indications and electronic circuits in the form of an integrated circuit which comprises an oscillator associated to the resonator, a frequency divider, means for performing at least one auxiliary function in dependence on an information being present at inputs thereof and a control circuit for the display means, said integrated circuit having a first group of m terminals whereof k are intended to connect said source with said electronic circuits and (m-k) to connect, at least indirectly, at least part of said control circuit for the display with at least part of said display means.

Most of the known electronic timepiece utilize quartz crystal oscillators as a time base. Such oscillators deliver pulses at a relatively high and very stable frequency of e.g. 32 kHz, to a frequency divider which is connected to the control circuit for the time display.

The operations required for precise frequency setting of the quartz crystal are time consuming and delicate and they are an important factor contributing to the increase of the price of such an element.

Different systems have been proposed to allow the utilization of quartz crystals which have not undergone such operations of frequency setting, which means that these quartz crystals have a natural frequency which is different from the theoretically necessary frequency.

Some of such systems, working with quartz crystals whose frequency is lower than the theoretical frequency, are provided with a frequency divider of which the dividing ratio may be decreased, or with a special circuit which adds, at given moments, correcting pulses to the input of one or more stages of the divider, so that the frequency of the signals delivered at the output of the divider becomes equal to the desired frequency.

Other systems, which are working with quartz crystals whose frequency is higher than the theoretical frequency, are arranged for suppressing a certain number of pulses at the input of the divider at predetermined time intervals.

Whatever the system is, the watches equipped therewith must be provided with means permitting at least the introduction and in certain cases the memorization of the information needed by the adjustment circuit so that the latter will be able to act on the divider circuit in such a way as to obtain at its output signals of the desired frequency.

One of the simplest means known to introduce the information needed by the adjustment circuit makes use of terminals of the integrated circuit which comprises all electronic circuits of the watch. Such terminals are intended and reserved for that purpose and they can be connected by switches, screws, soldered or glued bridges or the like to one or to the other pole of the electric power supply source which is generally a battery or an accumulator. A connection with the negative pole of the source means e.g. a logic state 0 and a connection with the positive pole a logic state 1. The terminals are simply connected to the inputs of the circuit for the adjustment of the frequency and the information of correction is given by the combination of the logic states 0 and 1 of the terminals.

By using such a simple system, it is possible with n terminals to introduce $2^n$ distinctive information. In order to introduce e.g. 64 information, 6 terminals must be provided. Now, it is known that the terminals of an integrated circuit are a possible source of failure because of the way they open to the humidity to penetrate into the circuit. The terminal contribute also to a considerable extent to the price of the integrated circuit. It is therefore desirable to limit their number as far as possible.

SUMMARY OF THE INVENTION

The object of the present invention is to provide means for appreciably increasing the number of distinctive information which can be introduced, and if necessary memorized, in a watch, for a given number of terminals intended for that purpose.

The object of the present invention is attained in an electronic timepiece having an integrated circuit further comprising an introduction circuit having information inputs connected to a second group of n terminals of said integrated circuit ($n \geqq 1$) and control inputs, each of said n terminals of said second group being capable to be connected, by a connection outside said integrated circuit, to one of said m terminals of said first group and said introduction circuit being arranged in such a way as to deliver to its outputs, at least periodically, one distinctive information for each of the $m^n$ possible combinations of said connections.

BRIEF DESCRIPTION OF THE DRAWINGS

The present invention will be described further by way of example with reference to the accompanying drawings, in which.

DESCRIPTION OF THE INVENTION

Figure 1:
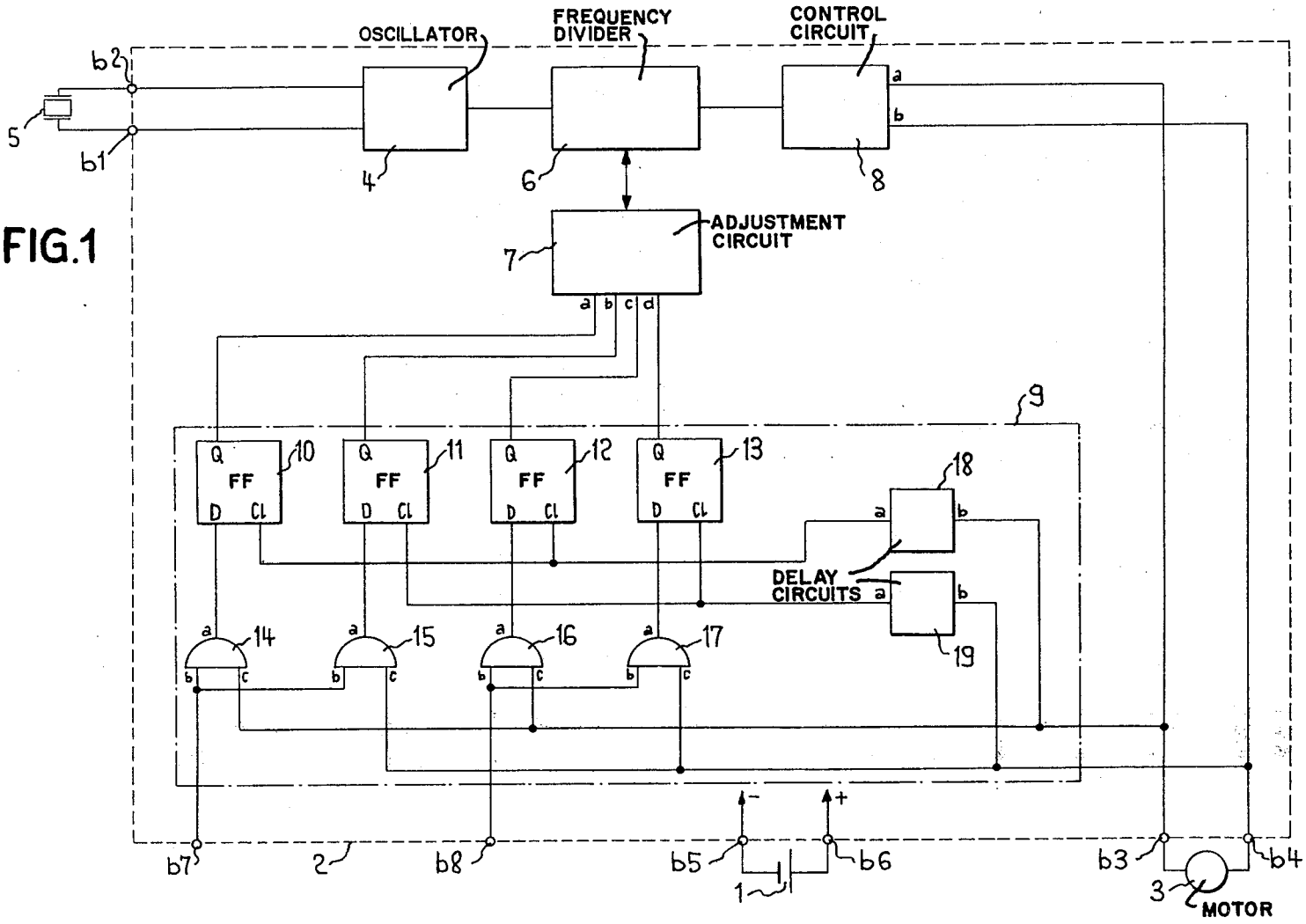
FIG. 1 is a block diagram of an electronic watch with a step motor, in accordance with the present invention.

The timepiece illustrated in FIG. 1 is an electronic watch with an analog display comprising an electric power supply source 1, an integrated circuit 2 and a motor 3 driving the hands of the watch by a non represented mechanism.

The integrated circuit 2 comprises well known circuits such as the oscillator 4, associated to a quartz crystal resonator 5, a frequency divider 6 and an adjustment circuit 7 for the frequency of the signal at the output of the divider 6. The adjustment circuit 7 can be of any of the circuit types described hereinabove; in the particular case of FIG. 1, the system requires that the information for the adjustment of the frequency be permanently present. The system requires also that the information are not only introduced but also memorized. Its connection with the divider 6 is symbolized by a single line, but actually, the connection would comprise a plurality of conductors transmitting information in both directions between the adjustment circuit and the divider, as indicated by the arrows at both ends of the stroke. A control circuit 8 receives the signals at the output of the divider 6 and delivers driving pulses to the motor 3. All these circuits are well known and their manner of working will not be described further.

The integrated circuit 2 is provided with 6 terminals, numbered from b1 to b6, which connect respectively the oscillator 4 to the quartz crystal 5, the motor 3 to the control circuit 8 and the power supply 1 to all electronic circuits. This latter connection is not represented in a detailed way but it is symbolized by both arrows designated by + and −.

The integrated circuit 2 further comprises an introduction and memorization circuit 9 which in this example comprises four flip-flops of D-type, 10 to 13, four AND gates 14 to 17 and two delay circuits 18 and 19.

The outputs Q of the FFs 10 to 13 are connected to the inputs *7a* to d respectively of the adjustment circuit 7. It shall be shown later that the binary information at the outputs Q of the FFs 10 to 13 is the information which is needed by the circuit 7 for the adjustment of the frequency of the signal at the output of the divider 6 to its correct value. The D-inputs of the FFs 10 to 13 are respectively connected to the outputs a of the gates 14 to 17. The clock inputs Cl of the FFs 10 and 12 are connected to the output a of circuit 18 and those of the FFs 11 and 13 to the output a of the delay circuit 19. The inputs b of the gates 14 and 15 are connected to each other and to an additional terminal b7 of the integrated circuit 2. The inputs b of the gates 16 and 17 are connected to a second additional terminal b8 of the integrated circuit 2. The inputs c of the gates 14 and 16 are connected to the output a and the inputs c of the gates 15 and 17 to the output b of the control circuit 8.

The inputs b of the delay circuits 18 and 19 are also connected to the outputs a and b respectively of the control circuit 8.

The terminals b7 and b8 are the input terminals for the information of adjustment and they can each be connected to any of the four terminals b3 to b6. Such interconnections, outside the integrated circuit, may be done by switches, screws, soldered or glued bridges or the like. Each of the $4^2$ combinations of possible connections corresponds to a distinctive information. It is seen that with the two terminals b7 and b8 only it is possible to introduce 16 information. With the known systems the number would be only 4.

Figure 2:
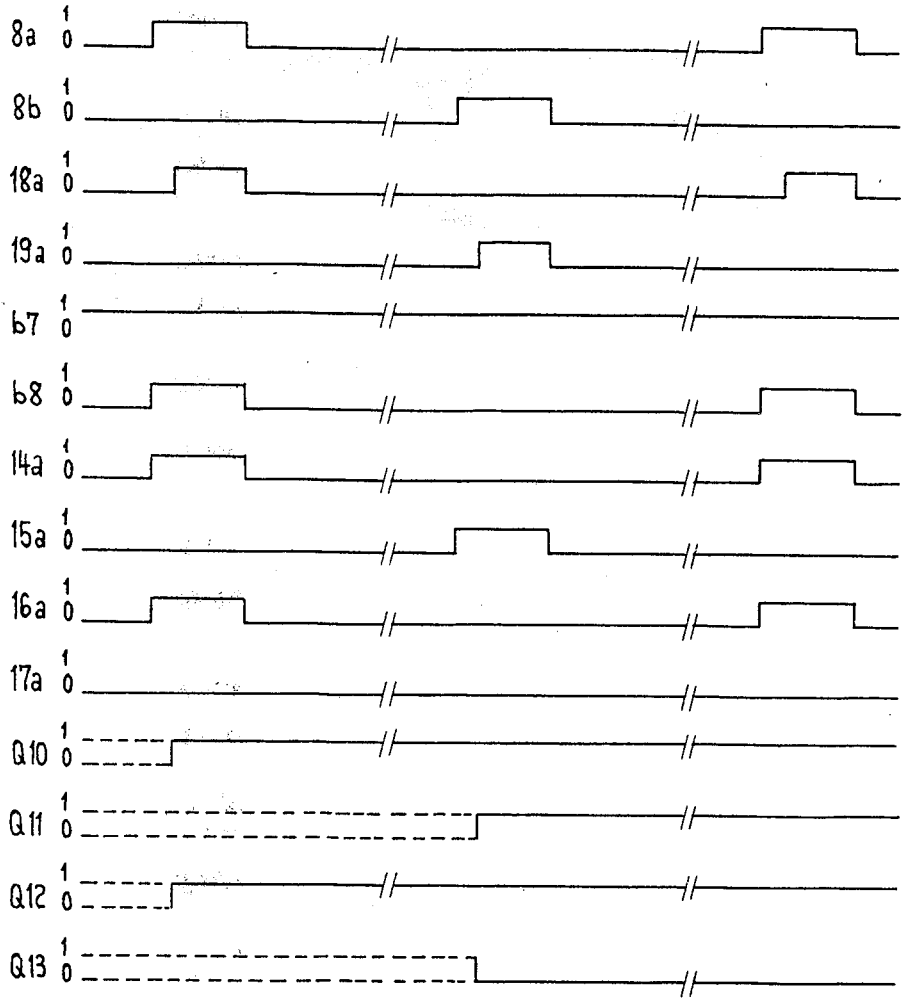
FIG. 2 is a pulse diagram of the circuit of FIG. 1.

An example, in which it will be admitted that the terminal b7 is connected to the terminal b6 and the terminal b8 to the terminal b3 shall help to understand the operation of the circuit, with the contribution of the diagram of FIG. 2, where each signal is designated by the reference of the point at which it appears.

Each driving pulse delivered by the output a of the control circuit 8 is to be found at the inputs c of the gates 14 and 16 as well as at the input b of the delay circuit 18. Moreover, since the terminals b3 and b8 are interconnected, the same pulse is also applied to the inputs b of the gates 16 and 17. The gate 16 has, during the pulse, both inputs b and c at the logic state 1 so that its output delivers also a signal 1 which is applied to the input D of the FF 12. The output a of the gate 14 and also the input D of the FF 10 changes over also to the state 1, since its input b is connected through the terminal b7 to the positive pole of the battery, the voltage of which corresponds to the logic state 1. The outputs a of the gates 15 and 17 remain at the logic state 0, since their inputs c are at 0 at this moment. A short moment later, the output a of the delay circuit 18 delivers a signal 1 which is applied to the input Cl of the FFs 10 and 12 the output of which switches to 1. The delay circuit 18 (and also the delay circuit 19) is introduced in the circuit only to insure that the FFs 10 and 12 (respectively 11 and 13) will operate correctly by slightly delaying the signal applied to their input Cl with regard to the signal which is applied to their input D.

The circuit remains in the state described above until the appearance of the next driving pulse which is delivered now by the output b of the control circuit 8. This pulse is applied to the inputs c of the gates 15 and 17 but it will be transmitted to the output a of the gate 15 only because the input b of this gate is connected through the terminal b7 to the positive pole of the battery. The input b of the gate 17 is at 0 since it is connected through the terminal b8 to the terminal b3 which is at 0 at this time. A moment later, when the output a of the delay circuit 19 delivers its signal, the output Q of the FF 11 switches to 1 or does not change its state if it is already at 1. The output Q of the FF 13 switches to 0 if it is not already in this logic state.

From this time on the state of the outputs Q of the FFs 10 to 13 does not change anymore. A further change can only take place if the connections between the terminals b7 and b8 on one hand and the terminals b3 to b6 on the other hand are modified or if the power supply is cut of e.g. during the change of the battery. In all cases, at the latest after two driving pulses, the information which corresponds to the connection between the different terminals is again available at the outputs Q of the FFs 10 to 13 and therefore also at the inputs a to d of the adjustment circuit 7. In this example, this information is represented by the binary number 1110 (in the order a, b, c, d).

The effect of the other possible connections may be easily seen: the terminal b7 exerts an influence on the state of the outputs Q of the FFs 10 and 11, the terminal b8 influences the state of the output of the FFs 12 and 13. A connection of one of these terminals with the terminal b5 causes the switching of the corresponding outputs to the state 00; a connection with b6 induces the switching to the state 11; a connection with b3 causes the switching in the order of the increasing numbers to the state 10 and a connection with b4 causes the switching to the state 01.

The following table shows the 16 possible cases of the described example.

| b7 b8 | Q10 | Q11 | Q12 | Q13 | b7 b8 | Q10 | Q11 | Q12 | Q13 |
|---|---|---|---|---|---|---|---|---|---|
| b3 b3 | 1 | 0 | 1 | 0 | b5 b3 | 0 | 0 | 1 | 0 |
| b3 b4 | 1 | 0 | 0 | 1 | b5 b4 | 0 | 0 | 0 | 1 |
| b3 b5 | 1 | 0 | 0 | 0 | b5 b5 | 0 | 0 | 0 | 0 |
| b3 b6 | 1 | 0 | 1 | 1 | b5 b6 | 0 | 0 | 1 | 1 |
| b4 b3 | 0 | 1 | 1 | 0 | b6 b3 | 1 | 1 | 1 | 0 |
| b4 b4 | 0 | 1 | 0 | 1 | b6 b4 | 1 | 1 | 0 | 1 |
| b4 b5 | 0 | 1 | 0 | 0 | b6 b5 | 1 | 1 | 0 | 0 |
| b4 b6 | 0 | 1 | 1 | 1 | b6 b6 | 1 | 1 | 1 | 1 |

With the described circuit, in which only two terminals are reserved for the information of adjustment it is thus possible to introduce and memorize $4^2=16$ distinctive informations. It is easy to generalize with more than two terminals: with n terminals it would be possible to introduce $4^n$ distinctive information; but only 2n AND gates (similar to the gates 14 to 17 of the preceding example) and 2n D flip-flops (similar to the FFs 10 to 13 of the example) would be needed.

Figure 3:
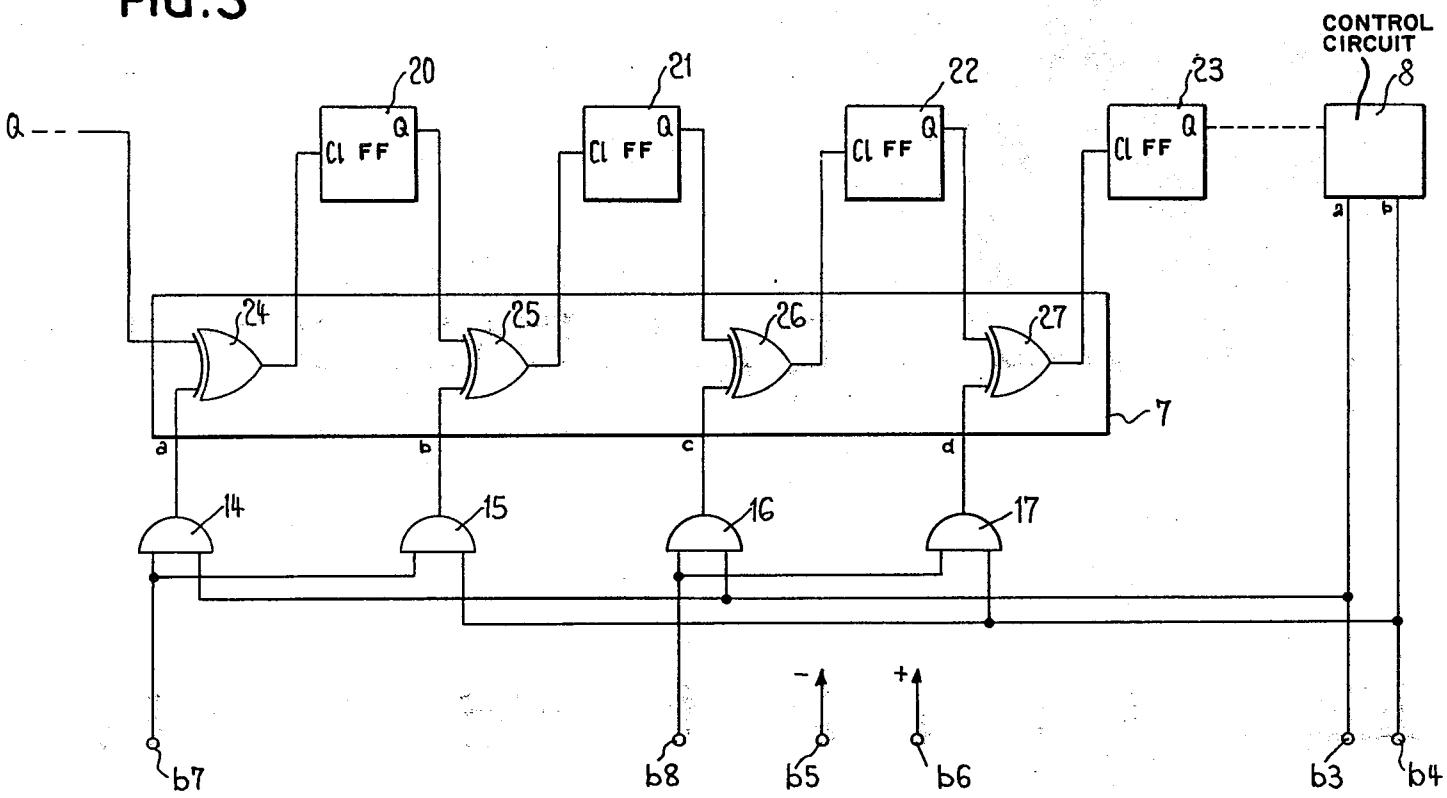
FIG. 3 is a partial block diagram of a particular case of the timepiece of FIG. 1.

The FIG. 3 shows a simplified version of the circuit of FIG. 1 which is intended for watches whose system for the adjustment of the frequency does not require that the information of correction be permanently present. In this circuit, the flip-flops 20 to 23 belong to the divider chain. The circuit 7 for the adjustment of the frequency is formed by the EXCLUSIVE-OR gates 24 to 27 which are connected between each clock input Cl of the FF 20 to 23 and the output of the immediately preceding flip-flop. The second inputs of the gates 24 to 27 are the inputs a to d of the adjustment circuit 7. When a logic signal 1 is applied to one of these inputs, an additional pulse appears at the clock input Cl of the next following flip-flop because of the inversion, during the presence of the signal of correction, of the pulses delivered by the output of the immediately preceding flip-flop. The position in the divider chain of the first EXCLUSIVE-OR gate and the period of the signals of correction define the amount of the smallest correction which can be accomplished. The number of these gates and again the period of the signals of correction define the amount of the greatest possible correction.

It is not necessary that the corrections are simultaneously accomplished at the various states. It is sufficient that they are done once for each period of correction. This period may be equal to that of the driving pulses. It is then possible to suppress the FFs 10 to 13 of FIG. 1 and to connect directly the outputs a of the gates 14 to 17 to the inputs a to d of the adjustment circuit 7. The delay circuits 18 and 19 are also suppressed.

Figure 4:
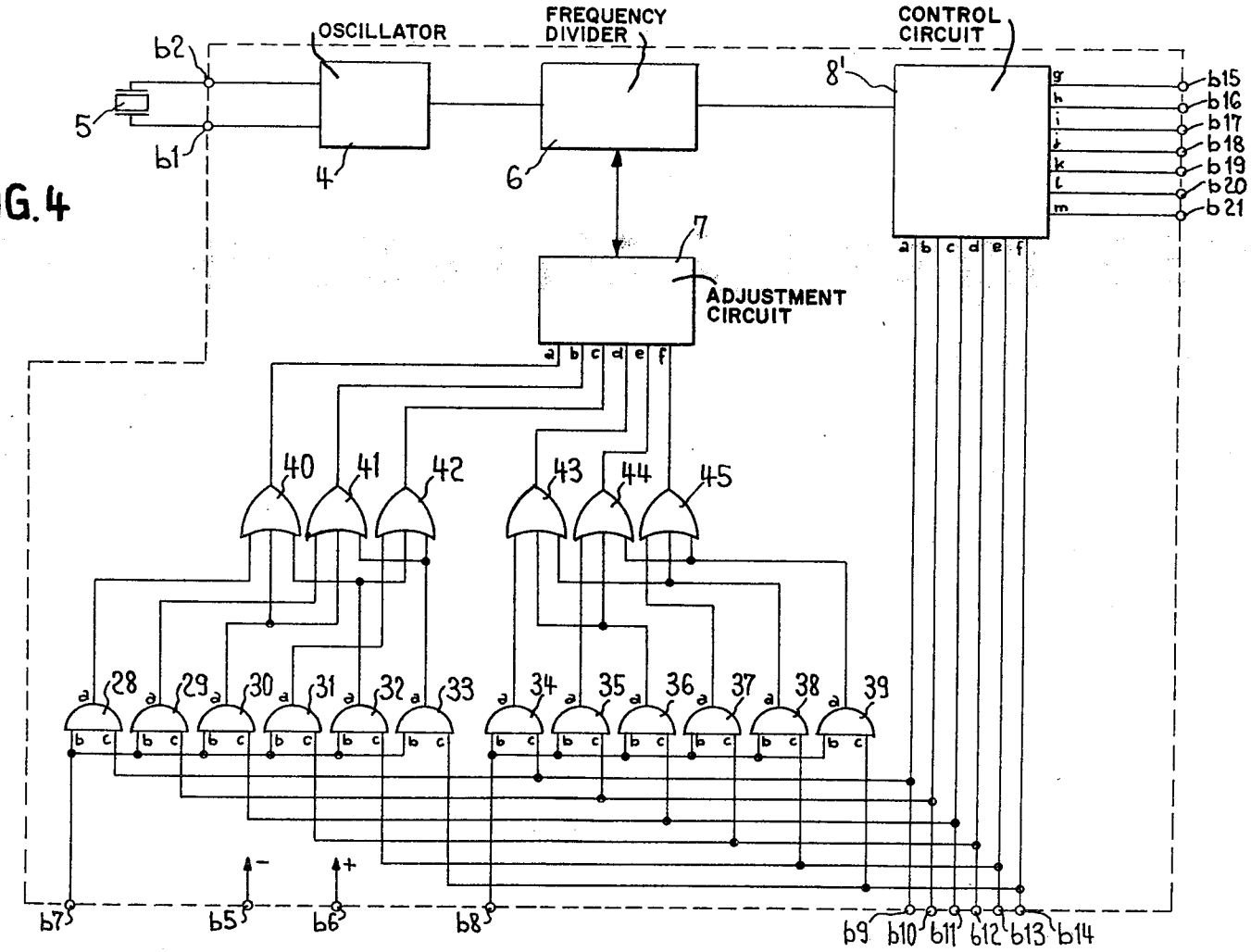
FIG. 4 is a block diagram of an electronic watch with a digital display of a first kind, in accordance with the present invention.

The FIG. 4 shows the block diagram of a watch with an active digital display formed e.g. by electroluminescent diodes (LED), utilizing the multiplexing technique. In such displays, the various ciphers are excited one after the other by a control signal which is applied to their common electrode by the control circuit of the display. The latter circuit also delivers simultaneously the control signals for the segments of the excited cipher, each segment being connected to all corresponding segments of the other ciphers. The FIG. 4 shows the terminals b9 to b14 for the control of the ciphers and b15 to b21 for the control of the segments.

The terminals b9 to b14 deliver successively and cyclicly the control signals for the ciphers. It is thus possible to further increase the number of distinctive information that can be introduced by the terminals intended for that purpose: if n is the number of input terminals and m is equal to the number of feeding terminals and of the terminals which deliver the control signals, it is possible to introduce $m^n$ distinctive information, since each of the n input terminals is capable to be connected to one of the m terminals, that means to one of the control terminals or one of both feeding terminals. In a watch with a 6-digits display it will be possible to introduce $8^2=64$ distinctive information with only two terminals intended for that purpose.

The FIG. 4 shows the oscillator 4 associated to the resonator 5, the frequency divider 6 and the adjustment circuit 7 associated to the divider 6. The latter delivers signals to a control circuit 8' for the display whose outputs a to f are each connected to a common electrode of one of the six ciphers of the non represented display through the terminals b9 to b14. The outputs g to m are each connected to one segment of all ciphers of the display through the terminals b15 to b21.

The AND gates 28 to 33 from which the first inputs b are connected to the terminal b7 and the AND gates 34 to 39 from which the first inputs b are connected to the terminal b8 have the same function as the gates 14 to 17 of the circuit of FIG. 1. Their second inputs c are connected by pairs (c of 28 and c of 34, c of 29 and c of 35 . . . ) to the outputs a to f of the control circuit 8' for the display and the outputs a of gates 28 to 39 are connected through a decoder comprising the OR gates 40 to 45 to the inputs a to f of the adjustment circuit 7 which, in that case, is similar to that which is described in the FIG. 3 and from which it differs only by the number of inputs.

In analogy with the case of the FIG. 1, a connection from the terminal b7 to the terminal b5 or b6 respectively brings all outputs a of the gates 28 to 33 to 0 or at 1 respectively, a connection with the terminal b9 causes one pulse to appear at the output a of the gate 28 once during each cycle of the pulses which control the ciphers, a connection with the terminal b10 causes one pulse to appear at the output a of the gate 29 also once during each cycle of the control pulses of the ciphers, and so on.

The same applies for the connections between the terminal b8 and one of the terminals b5, b6 or b9 to b14. These connections determine the signals which appear at the outputs a of the gates 34 to 39.

The OR gates 40 to 45 translate the code of the signal appearing at the outputs a of gates 28 to 39 into a binary code which, in the example cited, is necessary for the adjustment circuit 7. It is clear that if the adjustment circuit were of a different type, the code translation could also be different or even entirely non-existent. Either, if the adjustment circuit 7 needs permanently the information of correction or if the period of correction is different of that of the control of the ciphers, it is possible to add to the circuit flip-flops similar to the FFs 10 to 13 of the FIG. 1. If necessary, delay circuits similar to the circuits 18 and 19 of the FIG. 1 may also be provided.

In the watches with a non-multiplexed digital display, for example in the watches with liquid crystal display (LCD), the repetitive signals for the control of the ciphers are not present. Nevertheless, the invention can be used by providing a circuit as shown in FIG. 5.

Figure 5:
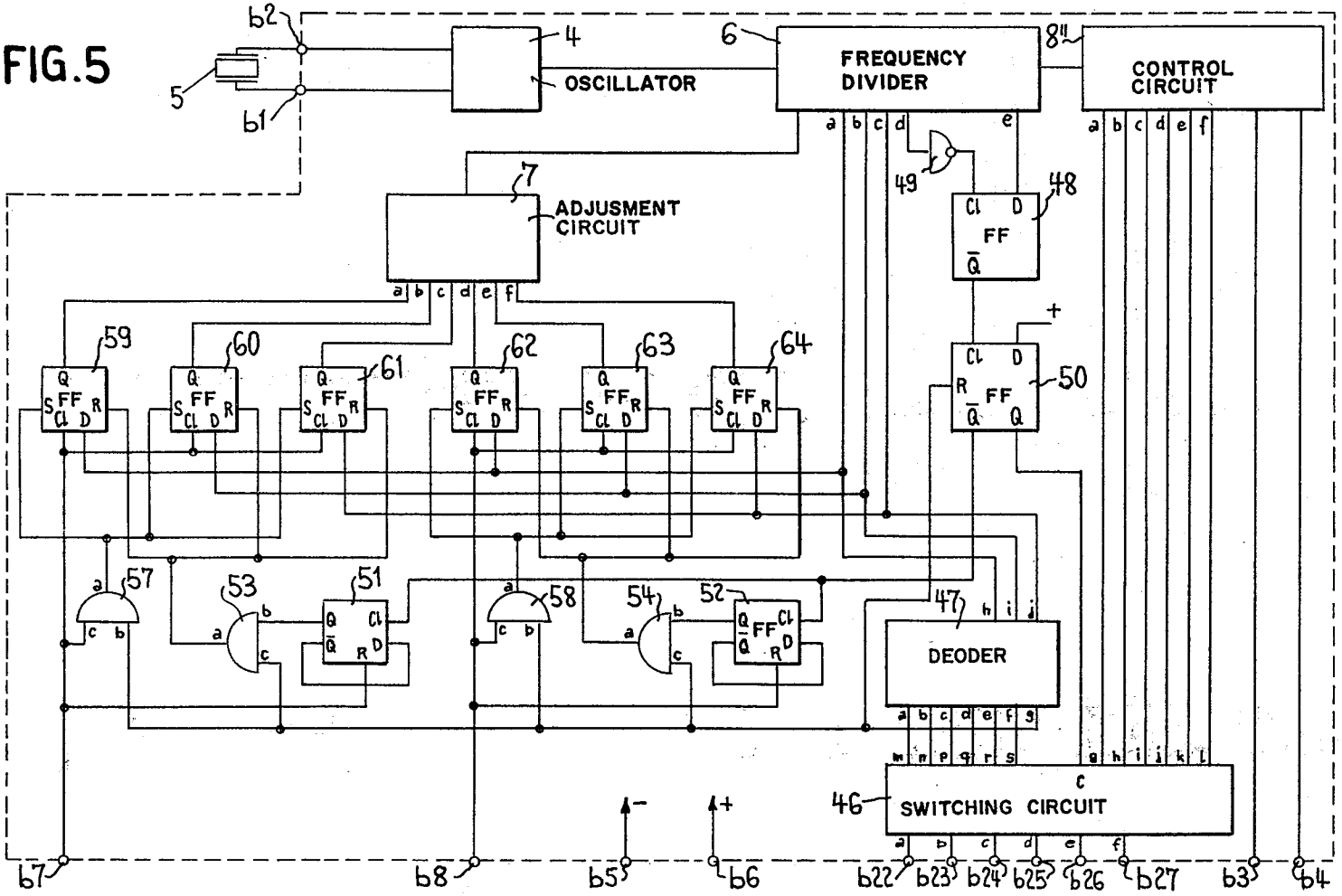
FIG. 5 is a block diagram of an electronic watch with a digital display of a second kind, in accordance with the present invention.

The FIG. 5 shows the oscillator 4 with its resonator 5, the frequency divider 6 and its adjustment circuit 7. The control circuit for the display is designated by 8''. Part of the information delivered by the circuit 8'' to the non-represented display is transmitted to the terminals b22 to b27 through a switching circuit 46 which is arranged in such a way that when its control input C is at the logic state 0 it delivers at its outputs a to f the information received at its inputs g to l from the outputs a to the f of the control circuit 8''. When the control input C is at the logic state 1, the switching circuit 46 delivers at its outputs the information present at its inputs m to s. The latter information is delivered by the outputs a to f of a decoder circuit 47 of which the inputs h to j are connected to outputs a to c of the divider 6. These three outputs and a fourth output d correspond to the outputs of four consecutive stages of the divider. A fifth output e of the divider corresponds to the output of one stage of the divider which delivers a signal whose period is clearly longer than that of the signals delivered by the outputs a to d. This period may equal, for example, the period of the corrections to be done.

The output e of the divider delivers signals to the input D of a flip-flop 48 from which the input Cl is connected through an inverter 49 to the output d of the divider 6. The output Q of this FF 48 delivers signals to the input Cl of another flip-flop 50 of which the input D is connected to the positive pole of the battery (equivalent to a logic state 1) and the resetting input R is connected to an output g of the decoder 47.

The outputs Q and Q of the FF 50 are connected respectively to the input C of the switch 46 and to the inputs Cl of two flip-flops 51 and 52 the inputs D of which are connected to their own outputs Q. The resetting inputs R of these flip-flops are connected to the terminals b7 and b8 respectively. Their outputs Q are connected to the first inputs b of the AND gates 53 and 54 from which the second inputs c are connected with each other and with the output g of the decoder 47.

Two AND gates 57 and 58 have their first inputs b connected to each other and to the output g of the decoder 47. Their second inputs c are connected to the terminals b7 and b8 respectively.

The inputs S (set) of three flip-flops 59 to 61 are connected to the output a of gate 57 and the inputs R (reset) of these flip-flops are connected to the output a of gate 53. Their inputs Cl are connected together and to the terminal b7 and their inputs D are each connected to one of the outputs a to c of the divider 6.

Similar interconnections are made between the inputs of three other flip-flops 62 to 64 and the outputs a of the gates 58 and 54 and also the outputs a to c of the divider 6. The outputs Q of the FF 59 to 64 are connected to the inputs a to f of the adjustment circuit 7 which, in this example, requires that the information of correction be permanently present.

Figure 6:
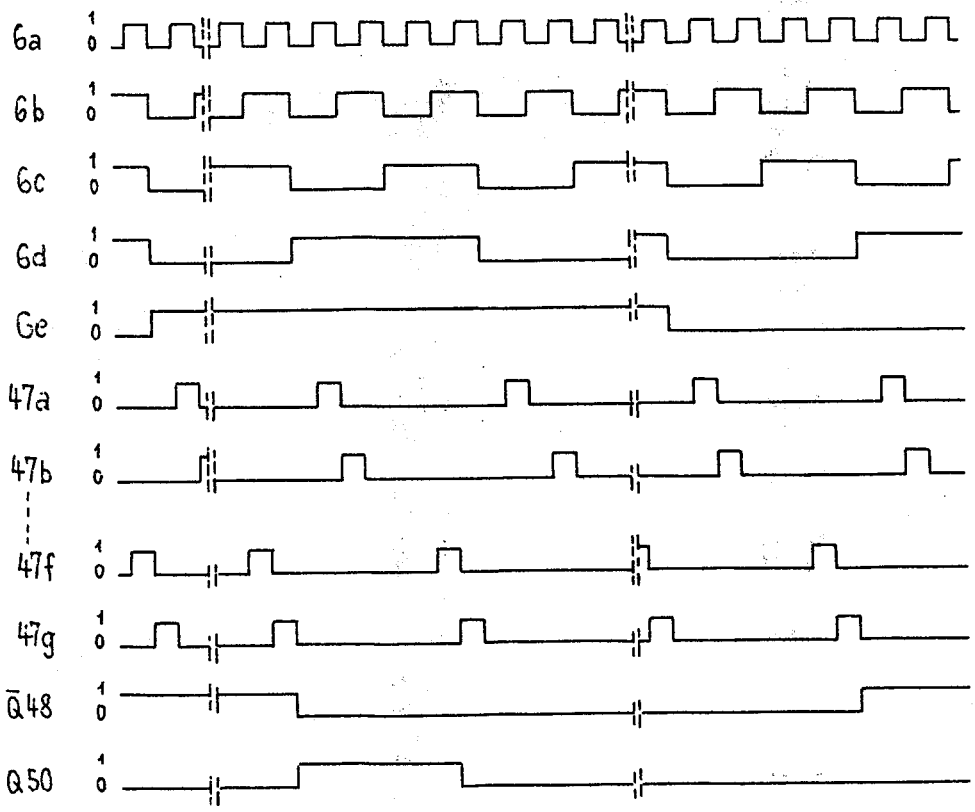
FIG. 6 is a pulse diagram of the circuit of FIG. 5.

The operation of the circuit is the following (see also FIG. 6): Normally, the output Q of the FF 50 is at the logic state 0 so that all terminals b22 to b27 deliver the control signals for the display, these signals being delivered by the control circuit 8''. When the output d of the divider 6 switches to the logic state 1, its output e being already in this same state, the FFs 48 and 50 change their states. The input C of the switch 46 changes to the state 1 and its outputs a to f deliver the signals which are present at its outputs m to s. The signals received by the display are therefore no more all correct but it will be seen later that the disturbance is in fact practically of no importance. Simultaneously, the FF 51 and 52 change over and their outputs Q switch to the state 1 except in one case which will be described later.

The signals delivered by the decoder 47 are pulses following one another at its outputs a to g. The output a delivers one pulse when the outputs a to c of the divider 6 are at the states 1,0 and 0; the output b delivers one pulse when the outputs a to c of the divider 6 are at the states 0, 1 and 0 and so on, and the output g when the outputs a to c of the divider 6 are at the states 1, 1 and 1.

If a connection is established between the terminals b23 and b7 for example, the pulse delivered by the output b of the decoder 47 is transmitted by the switch 46 and the terminals b23 and b7 to the inputs Cl of the FF 59 to 61. The outputs Q of these flip-flops then switch to the same states as the outputs a to c of the divider 6, namely 0, 1 and 0. Simultaneously the FF 51 is returned to zero, whereby the gate 53 is closed.

A connection between the terminal b7 and another of the terminals b22 to b27 would induce another logic state of the outputs Q of the FF 59 to 61.

Similar considerations can be applied to the circuit comprising the terminal b8 of which the connection with one of the terminals b22 to b27 influences the states of the outputs of the FF 62 to 64.

The circuit comprising the FFs 51 and 52 and the gates 53, 54, 57 and 58 will put the outputs of the FFs 59 to 64 into the desired logic state when one of the terminals b7 and b8 is connected to one of the terminals b5 or b6. If, for example, the terminal b7 is connected to the terminal b6, it will not receive any of the pulses delivered by the terminals b22 to b27. The FF 51 does not change over when the output Q of the FF 50 changes to 0 because its input R is maintained at the state 1. But, when the output g of the decoder 47 delivers its pulse, the latter is transmitted by the gate 57 to the inputs S of the FFS 59 to 61 of which the outputs Q change all to the state 1.

If the terminal b7 is connected to the terminal b5, the FF 51 is capable to change over when the output Q of the FF 50 changes to 0; its output Q changes over to 1, and when the output g of the decoder 47 delivers its pulse, the latter is transmitted to the inputs R of the FFS 59 to 61 from which the outputs change over to the state 0.

These returns to 0 or to 1 which are induced by the pulse delivered by the output g of the decoder 47 may never happen if the terminal b7 is connected to one of the terminals b22 to b27. In this case, the gates 53 and 57 never have their two inputs simultaneously at the state 1 since the FF 51 is returned to zero by the pulse received by the terminal b7 before the appearance of the pulse at the output g of the decoder 47.

The working manner of the circuit comprising the FF 52 and the gates 54 and 58 is similar to that of the circuit just described.

When the output g of the decoder 47 delivers its pulse, the latter resets the FF 50 of which the output Q changes over again to 0. The switch 46 starts again to transmit to the terminals b22 to b27 the signals delivered by the outputs a to f of the control circuit 8'' for the display.

Each combination of the connections between the terminals b7 and b8 on one hand and the terminals b5, b6 and b22 to b27 on the other hand causes a distinctive information to appear at the outputs Q of the FF 59 to 64. This information is formed by a 6-bits binary number. It is thus possible to deliver to the adjustment circuit 7 a number of 64 information with only two terminals reserved for their introduction.

If one admits that the output a of the divider 6 is the output of the first dividing stage and that it delivers pulses the repetition frequency of which is 16 kHz (if the oscillator has a frequency of 32 kHz) and that the output e is the output of the fifteenth dividing stage delivering pulses of which the repetition frequency is 1 Hz, the output Q of the FF 50 stays at the state 1 for less than 250 microseconds, one time each second. The disturbance of the display during such a short time is without importance.

It is obvious that if the memorization of the information of correction is not necessary it is possible to combine the circuits of the FIGS. 4 and 5. In this case, the signals delivered by the decoder 47 (FIG. 5) are supplied to the inputs c of the gates 28 to 39 (FIG. 4). The output Q of the FF 50 may be used to control the decoder which should then be suitable for delivering signals at its outputs only during the time when the output Q of the FF 50 is at the state 1.

It is possible to imagine other embodiments of the invention. For example, it is possible to directly utilize the signals delivered by the outputs Q of the FFs 51 and 52 which are at the state 1 during certain times depending on the connection between the terminals b7 and b8 and the terminals b5, b6 or b22 to b27 to control an adjustment circuit which would be arranged to accomplish corrections during a predetermined time.

The circuits described above may be used for another purpose than the introduction of an information of correction of the frequency. We may consider, for example, the case of a watch provided with one microprocessor the program of which has numerous sub-programs and which is capable to control selectively a great number of different functions such as e.g. the display of the information on 2, 4, 6 or more digits, various systems of time setting, various types of chronometers, alarm or recall functions, electronic games, and so on. In order to adapt such a circuit, which we may call universal, to a given watch type it would be only necessary to introduce, with circuits similar to those which have been described above, and information which the microprocessor would utilize to make a choice amongst its subprograms, selecting those which are adapted to the kind of watch it is intended to realize. It would thus be possible to manufacture this universal circuit in mass production which would reduce its unitary price, and, to offer for sale very different watch types with different functions only by establishing a few connections between reserved terminals of the integrated circuit.

The circuits which have been described above are examples of various embodiments only and it would be possible to modify the types of elements used and their interconnections without departing from the essential spirit of the invention.

We claim:

1. An electronic timepiece, comprising:

a power source;

means for displaying time data in response to display control signals;

an integrated circuit provided with m terminals comprising power terminals for connecting said power source and display terminals for connecting said displaying means, and further provided with n terminals for applying input signals, said integrated circuit including means for producing time base pulses, means for producing said display control signals in response to said time base pulses, an introduction circuit for producing auxiliary data in response to said input signals and said display control signals, and means for performing an auxiliary function in response to said auxiliary data; and a plurality of connections external to said integrated circuit for selectively connecting each of said n terminals to one of said m terminals, said input signals and, thus, said auxiliary data being different for each of the $m^n$ possible combinations of said connections and each different set of said auxiliary data being present only so long as said corresponding combination of said connections remain in place.

2. The electronic timepiece of claim 1, wherein said time base pulses producing means comprises an oscillator for producing a high frequency signal and a frequency divider responsive to said high frequency signal for producing said time base pulses, and wherein said auxiliary function performing means comprises means for adjusting the division ratio of said frequency divider in response to said auxiliary data.

3. The electronic timepiece of claim 1, wherein said introduction circuit comprises means for storing said auxiliary data in response to said display control signals.

4. The electronic timepiece of claim 1, wherein said integrated circuit further comprises means for producing sequence signals, means for alternatively applying said sequence signals and said display control signals to said display terminals, and means for applying said input signals to said introduction circuit in response to said sequence signals.

* * * * *